US006357252B1

(12) United States Patent
Rand

(10) Patent No.: US 6,357,252 B1
(45) Date of Patent: Mar. 19, 2002

(54) PORTABLE COOLER APPARATUS

(76) Inventor: John W. Rand, 18450 Bethel Grove Rd., Belmont, WI (US) 53510

( * ) Notice: Subject to any disclaimer, the term of this patent is extended or adjusted under 35 U.S.C. 154(b) by 0 days.

(21) Appl. No.: 09/602,113

(22) Filed: Jun. 23, 2000

(51) Int. Cl.[7] ..... F25D 3/08
(52) U.S. Cl. ..... 62/457.7; 62/457.2
(58) Field of Search ..... 62/457.7, 457.2, 62/457.1, 457.4, 371, 441, 458

(56) References Cited

U.S. PATENT DOCUMENTS 4,383,422 A * 5/1983 Gordon et al. ..... 62/457.4
4,630,671 A 12/1986 Sherman et al.
4,655,052 A 4/1987 Garcia
4,841,661 A * 6/1989 Moore
4,916,923 A * 4/1990 Adams et al. ..... 62/457.1
D311,114 S 10/1990 Orton
5,329,787 A 7/1994 Friday
5,605,056 A * 2/1997 Brown et al. ..... 62/457.4
5,653,124 A * 8/1997 Weber ..... 62/457.4
5,660,310 A * 8/1997 LeGrow ..... 62/457.1 X
5,704,485 A 1/1998 Cautereels et al.
5,816,433 A 10/1998 Higgins
5,864,981 A * 2/1999 Zeman ..... 62/457.1 X

* cited by examiner

*Primary Examiner*—Henry Bennett
*Assistant Examiner*—Chen Wen Jiang

(57) ABSTRACT

A portable cooler apparatus for keeping the food and beverages cold and dry. The portable cooler apparatus includes a container having an upper bottom wall, a lower bottom wall spaced from the upper bottom wall, side and end walls, an open top, a hole extending through one of the end walls, an upper storage compartment, a lower storage compartment, and an opening extending through one of the side walls and into the lower storage compartment; and also includes a lid member being hingedly attached to the container and being latchingly attached over the open top for closing the container; and further includes handle members attached to the container for carrying the container; and further includes a drawer member slidably disposed through the opening into the lower storage compartment for supporting food and beverages; and also includes disc-like attachment members being adapted to attach to hand-held containers and being stored within the container; and freezable gelatin substances disposed within the drawer member and the disc-like attachment members for keeping the food and beverages cold and dry.

8 Claims, 4 Drawing Sheets

PORTABLE COOLER APPARATUS

BACKGROUND OF THE INVENTION

1. Field of the Invention

The present invention relates to a dry pack cooler and more particularly pertains to a new portable cooler apparatus for keeping the food and beverages cold and dry.

2. Description of the Prior Art

The use of a dry pack cooler is known in the prior art. More specifically, a dry pack cooler heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,816,433; U.S. Pat. No. 4,655,052; U.S. Pat. No. 5,329,787; U.S. Pat. No. 5,704,485; U.S. Pat. No. 4,630,671; and U.S. Pat. No. Des. 311,114.

While these devices fulfill their respective, particular objectives and requirements, the aforementioned patents do not disclose a new portable cooler apparatus. The inventive device includes a container having an upper bottom wall, a lower bottom wall spaced from the upper bottom wall, side and end walls, an open top, a hole extending through one of the end walls, an upper storage compartment, a lower storage compartment, and an opening extending through one of the side walls and into the lower storage compartment; and also includes a lid member being hingedly attached to the container and being latchingly attached over the open top for closing the container; and further includes handle members attached to the container for carrying the container; and further includes a drawer member slidably disposed through the opening into the lower storage compartment for supporting food and beverages; and also includes disc-like attachment members being adapted to attach to hand-held containers and being stored within the container; and freezable gelatin substances disposed within the drawer member and the disc-like attachment members for keeping the food and beverages cold and dry.

In these respects, the portable cooler apparatus according to the present invention substantially departs from the conventional concepts and designs of the prior art, and in so doing provides an apparatus primarily developed for the purpose of keeping the food and beverages cold and dry.

SUMMARY OF THE INVENTION

In view of the foregoing disadvantages inherent in the known types of dry pack cooler now present in the prior art, the present invention provides a new portable cooler apparatus construction wherein the same can be utilized for keeping the food and beverages cold and dry.

The general purpose of the present invention, which will be described subsequently in greater detail, is to provide a new portable cooler apparatus which has many of the advantages of the dry pack cooler mentioned heretofore and many novel features that result in a new portable cooler apparatus which is not anticipated, rendered obvious, suggested, or even implied by any of the prior art dry pack cooler, either alone or in any combination thereof.

To attain this, the present invention generally comprises a container having an upper bottom wall, a lower bottom wall spaced from the upper bottom wall, side and end walls, an open top, a hole extending through one of the end walls, an upper storage compartment, a lower storage compartment, and an opening extending through one of the side walls and into the lower storage compartment; and also includes a lid member being hingedly attached to the container and being latchingly attached over the open top for closing the container; and further includes handle members attached to the container for carrying the container; and further includes a drawer member slidably disposed through the opening into the lower storage compartment for supporting food and beverages; and also includes disc-like attachment members being adapted to attach to hand-held containers and being stored within the container; and freezable gelatin substances disposed within the drawer member and the disc-like attachment members for keeping the food and beverages cold and dry.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims append ed hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis f or the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable cooler apparatus which has many of the advantages of the dry pack cooler mentioned heretofore and many novel features that result in a new portable cooler apparatus which is not anticipated, rendered obvious, suggested, or even implied by any of the prior art dry pack cooler, either alone or in any combination thereof.

It is another object of the present invention to provide a new portable cooler apparatus which may be easily and efficiently manufactured and marketed.

It is a further object of the present invention to provide a new portable cooler apparatus which is of a durable and reliable construction.

An even further object of the present invention is to provide a new portable cooler apparatus which is susceptible of a low cost of manufacture with regard to both materials and labor, and which accordingly is then susceptible of low prices of sale to the consuming public, thereby making such portable cooler apparatus economically available to the buying public.

Still yet another object of the present invention is to provide a new portable cooler apparatus which provides in the apparatuses and methods of the prior art some of the advantages thereof, while simultaneously overcoming some of the disadvantages normally associated therewith.

Still another object of the present invention is to provide a new portable cooler apparatus for keeping the food and beverages cold and dry.

Yet another object of the present invention is to provide a new portable cooler apparatus which includes a container having an upper bottom wall, a lower bottom wall spaced from the upper bottom wall, side and end walls, an open top, a hole extending through one of the end walls, an upper storage compartment, a lower storage compartment, and an opening extending through one of the side walls and into the lower storage compartment; and also includes a lid member being hingedly attached to the container and being latchingly attached over the open top for closing the container; and further includes handle members attached to the container for carrying the container; and further includes a drawer member slidably disposed through the opening into the lower storage compartment for supporting food and beverages; and also includes disc-like attachment members being adapted to attach to hand-held containers and being stored within the container; and freezable gelatin substances disposed within the drawer member and the disc-like attachment members for keeping the food and beverages cold and dry.

Still yet another object of the present invention is to provide a new portable cooler apparatus that easily and conveniently keeps a cooler cold.

Even still another object of the present invention is to provide a new portable cooler apparatus that prevents food from being waterlogged and messy due to melting ice disposed within a conventional cooler.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description there of. Such description makes reference to the annexed drawings wherein.

DESCRIPTION OF THE PREFERRED EMBODIMENT

Figure 1:
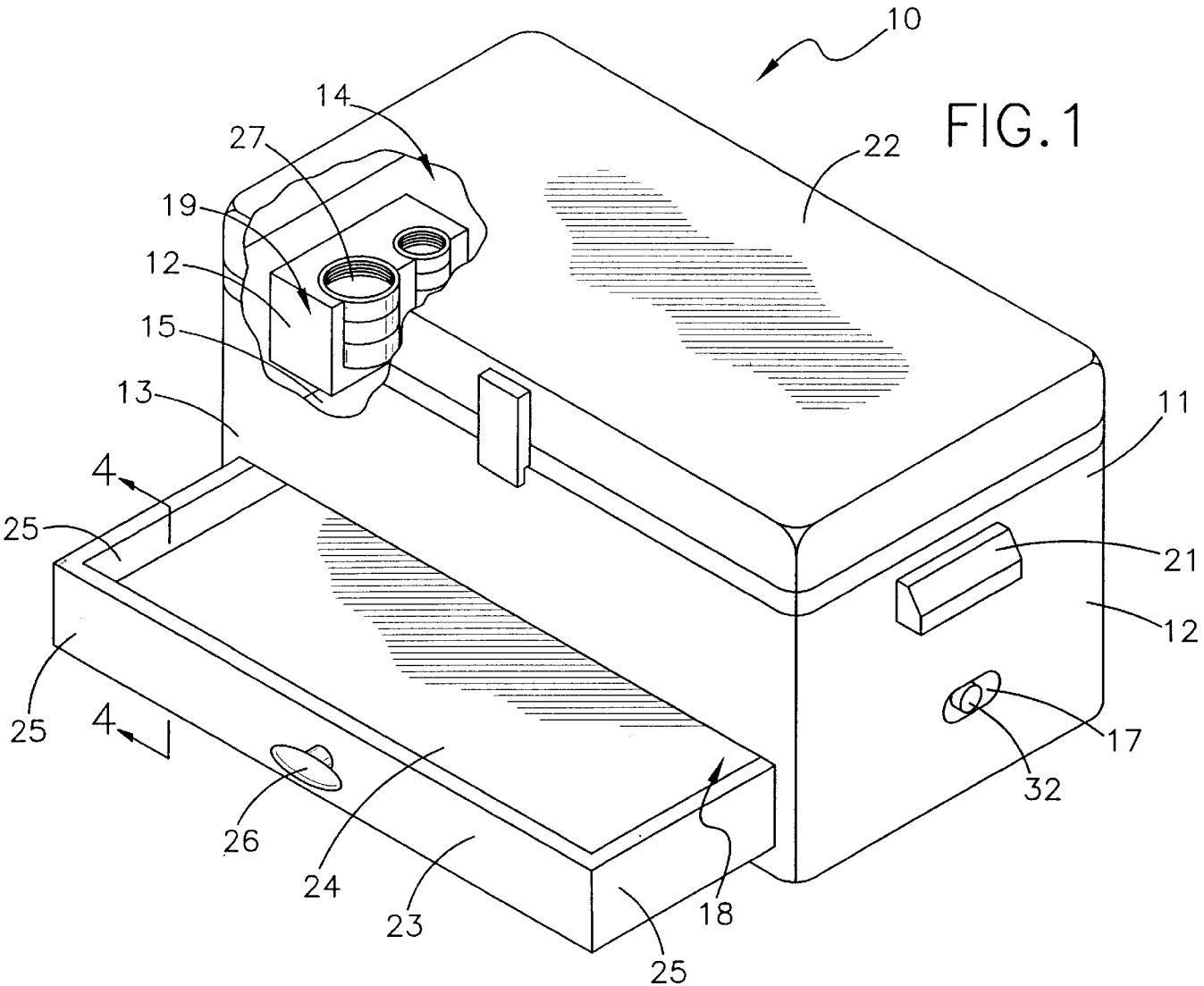
FIG. 1 is a perspective view of a new portable cooler apparatus according to the present invention.
Figure 2:
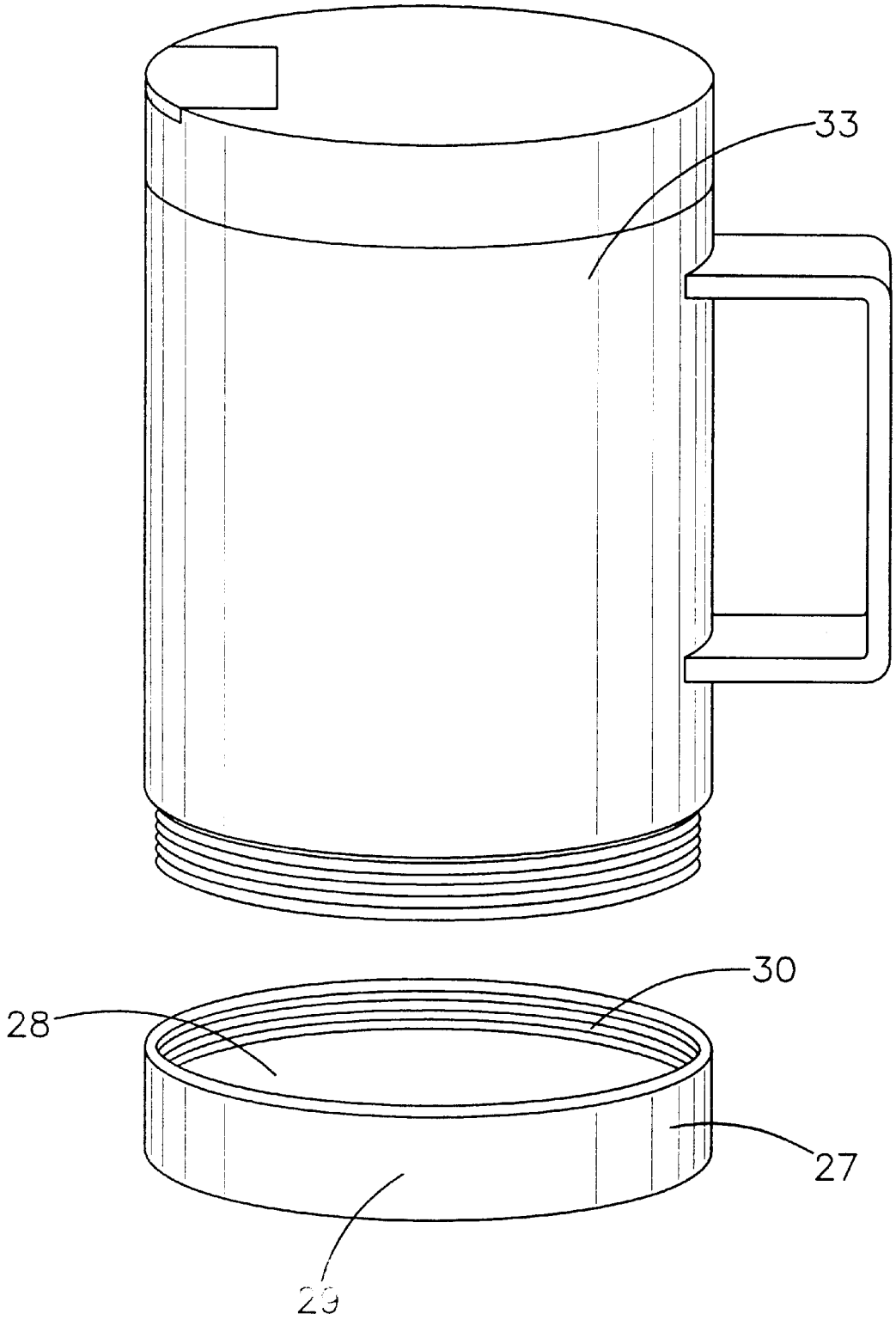
FIG. 2 is a perspective view of one of the disc-like attachment members being used with a drinking containing of the present invention.
Figure 3:
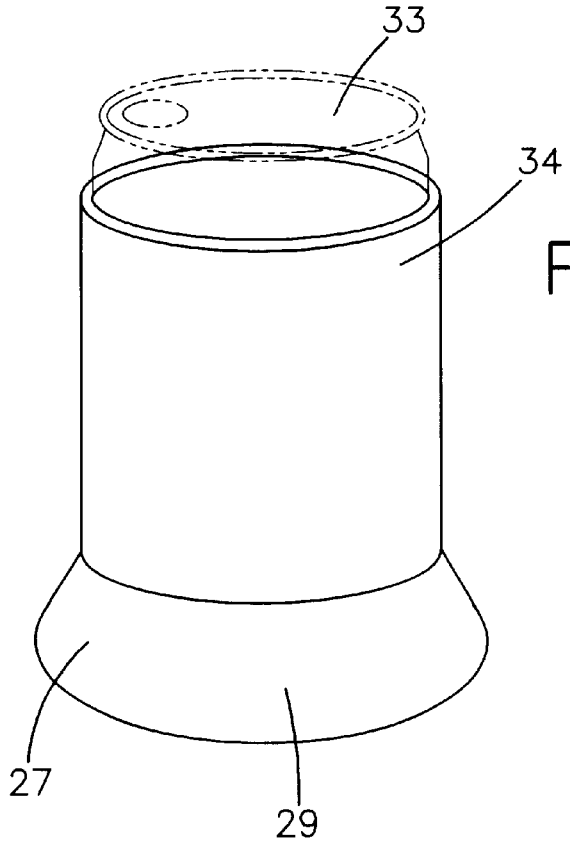
FIG. 3 is a perspective view of one of the disc-like attachment members being used with a drinking container holder of the present invention.
Figure 4:
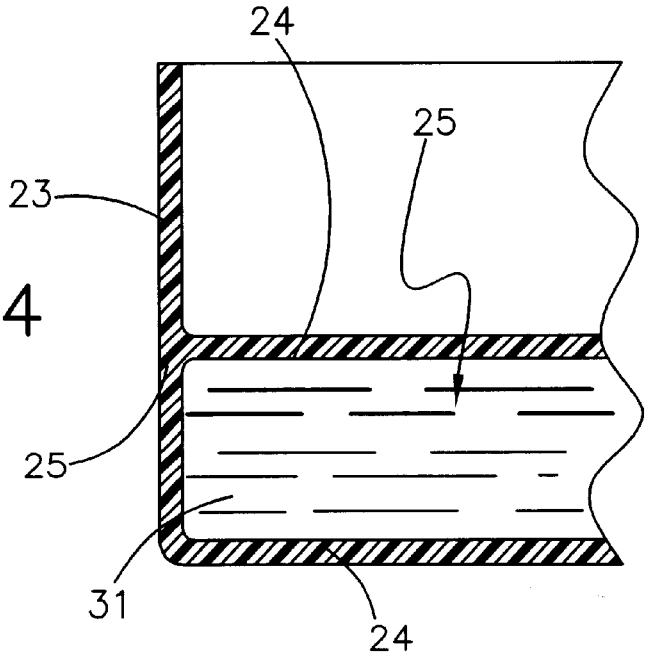
FIG. 4 is a partial cross-sectional view of the drawer member of the present invention.
Figure 5:
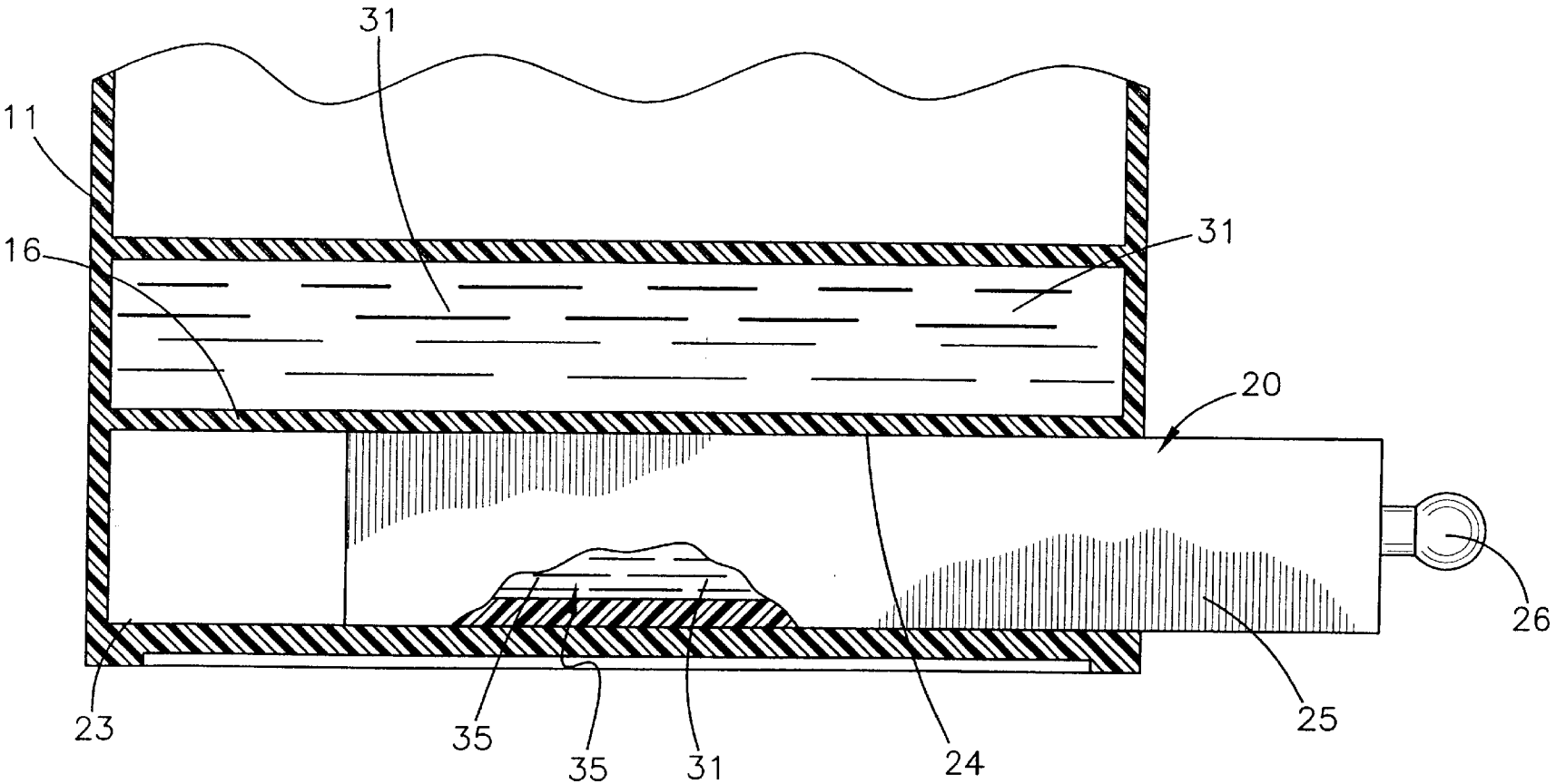
FIG. 5 is a cross-sectional view of the container of the present invention.

With reference now to the drawings, and in particular to FIGS. 1 through 5 thereof, a new portable cooler apparatus embodying the principles and concepts of the present invention and generally designated by the reference numeral 10 will be described.

As best illustrated in FIGS. 1 through 5, the portable cooler apparatus 10 generally comprises a container 11 having an upper bottom wall 15, a lower bottom wall 16 spaced from the upper bottom wall 15, side and end walls 12,13, an open top 14, an upper storage compartment 19, a hole 17 extending through one of said end walls 12 into said upper storage compartment 19 and being closeable with a plug 32 for draining water therein, a lower storage compartment 20, and an opening extending 18 through one of the side walls 13 and into the lower storage compartment 20 with the container 11 having a length of approximately 24 inches, a width of approximately 18 inches, and a height of approximately 18 inches. A lid member 22 is hingedly attached to the container 11 and is latchingly attached over the open top 14 for closing the container 11. Handle members 21 are conventionally attached to the container 11 for carrying the container 11. A drawer member 23 is slidably and removably disposed through the opening 18 into the lower storage compartment 20 for supporting food and beverages. The drawer member 23 includes end walls 25, side walls 25, a bottom wall 24, and a handle 26 and conventionally securely attached to one of the side walls 25 with each of the walls 24,25 having a cavity therein. Disc-like attachment members 27 are adapted to attach to hand-held containers 33,34 including drinking containers and are stored within the container 11. Each of the disc-like attachment members 27 includes a side wall 29 and a bottom wall 28 which has a cavity therein. Each of the disc-like attachment members 27 is threaded upon an interior 30 of the side wall 29 and is threaded upon a bottom end of a hand-held container 33,34 including a drinking container with the disc-like attachment members 27 being stored and arranged upon a support member. Freezable Gelatin substances 31 are disposed within the drawer member 23 and the disc-like attachment members 27 for keeping the food and beverages cold and dry. The gelatin substances 31 are disposed within the cavities 35 of the walls 24,25 of the drawer members 27 with the gelatin substances 31 being adapted to be frozen and adapted to keep the food and beverages cold and dry for long periods of time.

In use, the user removes the drawer member 23 and the disc-like attachment members 27 and places them in a freezer until the gelatin substances 31 become frozen. After which, the user inserts the drawer member 23 back into the container 11 and threads the disc-like attachment members 27 upon the bottom ends of hand-held containers 33,34 including drinking containers and drinking container holders with the gelatin substances 31 being used to keep the food and beverages cold for long periods of time.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A portable cooler apparatus comprising:

a container having an upper bottom wall, a lower bottom wall spaced from said upper bottom wall, side and end walls, an open top, an upper storage compartment, a hole extending through one of said end walls and being closeable with a plug, a lower storage compartment, and an opening extending through one of said side walls and into said lower storage compartment;

a lid member being hingedly attached to said container and being latchingly attached over said open top for closing said container;

handle members attached to said container for carrying said container;

a drawer member slidably disposed through said opening into said lower storage compartment for supporting food and beverages;

disc-like attachment members being adapted to attach to hand-held containers and being stored within said container; and freezable gelatin substances disposed within said drawer member and said disc-like attachment members for keeping the food and beverages cold and dry;

wherein said drawer member includes end walls, side walls, a bottom wall, and a handle securely attached to one of said side walls, each of said walls having a cavity therein;

wherein each of said disc-like attachment members includes a side wall and a bottom wall which has a cavity therein; and wherein each of said disc-like attachment members is threaded upon an interior of said side wall and is threaded upon a bottom end of a hand-held container including a drinking container.

2. A portable cooler apparatus as described in claim 1, wherein said gelatin substances are disposed within said cavities of said walls of said drawer member and said bottom walls of said disc-like attachment members.

3. A portable cooler apparatus as described in claim 1, wherein said gelatin substances is adapted to be frozen and adapted to keep the food and beverages cold and dry.

4. A portable cooler apparatus comprising:

a container having an upper bottom wall, a lower bottom wall spaced from said upper bottom wall, side and end walls, an open top, an upper storage compartment, a lower storage compartment, and an opening extending through one of said side walls and into said lower storage compartment;

a lid member for removably mounting on said container over said open top for closing said container;

a drawer member slidably disposed through said opening into said lower storage compartment;

at least one cooling attachment member being adapted to attach to a drinking container, said at least one cooling attachment member being storable in said container, said at least one cooling attachment member having a threaded surface for threadedly mounting the at least one cooling attachment member on a complementary threaded portion of the drinking container; and a freezable gelatinous substance disposed in said at least one cooling attachment member for drawing heat from the drinking container when said at least one cooling attachment member is attached to the drinking container.

5. A portable cooler apparatus as described in claim 4, wherein said drawer member includes end walls, side walls, a bottom wall, and a handle securely attached to one of said side walls, each of said walls having a cavity therein.

6. A portable cooler apparatus as described in claim 4, wherein said gelatin substance is disposed in said cavities of said walls of said drawer member and a bottom wall of said at least one cooling attachment member.

7. A portable cooler apparatus as described in claim 4, wherein said gelatin substance is adapted to be frozen and adapted to keep the food and beverages cold and dry.

8. A portable cooler apparatus comprising:

a container having an upper bottom wall, a lower bottom wall spaced from said upper bottom wall, side and end walls, an open top, an upper storage compartment, a lower storage compartment, and an opening extending through one of said side walls and into said lower storage compartment;

a lid member for removably mounting on said container over said open top for closing said container;

a drawer member slidably disposed through said opening into said lower storage compartment, said drawer member including end walls, side walls, a bottom wall, at least one of said walls having a closed cavity formed therein; and a freezable gelatinous substance disposed within said closed cavity in said at least one wall of said drawer such that said freezable gelatinous substance is carried by said drawer and is removable from said container with said drawer.

* * * * *